US005427502A

United States Patent [19]

Hudson

[11] Patent Number: 5,427,502

[45] Date of Patent: Jun. 27, 1995

[54] FAN SHROUD ASPIRATOR

[75] Inventor: Scott A. Hudson, Cedar Falls, Iowa

[73] Assignee: Deere & Company, Moline, Ill.

[21] Appl. No.: 218,921

[22] Filed: Mar. 28, 1994

[51] Int. Cl.[6] ..... F04D 29/54

[52] U.S. Cl. ..... 415/211.1; 415/208.1; 415/223; 55/385.3; 180/68.1; 123/41.7; 123/41.49

[58] Field of Search ..... 415/208.1, 211.1, 223, 415/214.1, 185, 186; 416/169 A; 55/385.3, 467; 180/68.1; 123/41.49, 41.7

[56] References Cited

U.S. PATENT DOCUMENTS

| | | | |
|---|---|---|---|
| 2,197,503 | 4/1940 | Martin . | |
| 2,708,920 | 5/1955 | Pasturczak . | |
| 2,795,291 | 6/1957 | Pierce . | |
| 3,104,962 | 9/1963 | Duer . | |
| 3,137,553 | 6/1964 | Billey . | |
| 3,186,389 | 6/1965 | Sylvan . | |
| 4,086,976 | 5/1978 | Holm et al. | 123/41.49 |
| 4,173,995 | 11/1979 | Beck | 123/41.49 |
| 4,233,040 | 11/1980 | Vogelaar et al. . | |
| 4,249,922 | 2/1981 | Saele . | |
| 4,469,490 | 9/1984 | Wilson . | |
| 4,606,422 | 8/1986 | Jewett | 55/385.3 |
| 5,279,503 | 1/1994 | Propst | 416/169 A |

*Primary Examiner*—Edward K. Look
*Assistant Examiner*—Christopher Verdier

[57] ABSTRACT

An aspirator is mounted on a fan shroud surrounding a vehicle cooling fan. The aspirator has a housing which forms a duct which connects an opening to a port for connecting to a vehicle function. The aspirator is spaced apart from the fan and upstream from the fan and extends at an acute angle with respect to a tangent to a cylindrical wall of the shroud. The aspirator has a near edge which faces generally opposite to a direction of rotation of the fan blades and which is parallel to a leading edge of a fan blade when the leading edge is spaced apart from the near edge by a distance which is slightly larger than the width of the fan blade. The aspirator has a flange which projects parallel to a plane of rotation of the fan and generally in the rotation direction of the fan. The duct has a triangular cross sectional shape with an apex which projects in a direction which is upstream with respect flow of air moved by the fan.

11 Claims, 3 Drawing Sheets

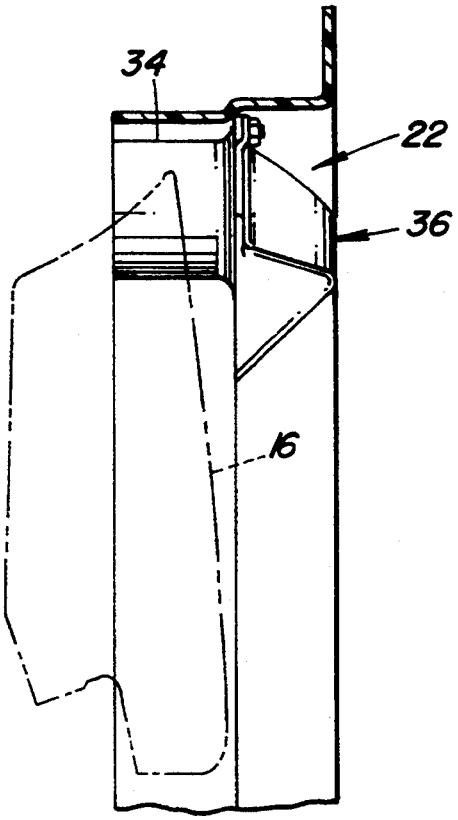
Fig. 3
Fig. 1
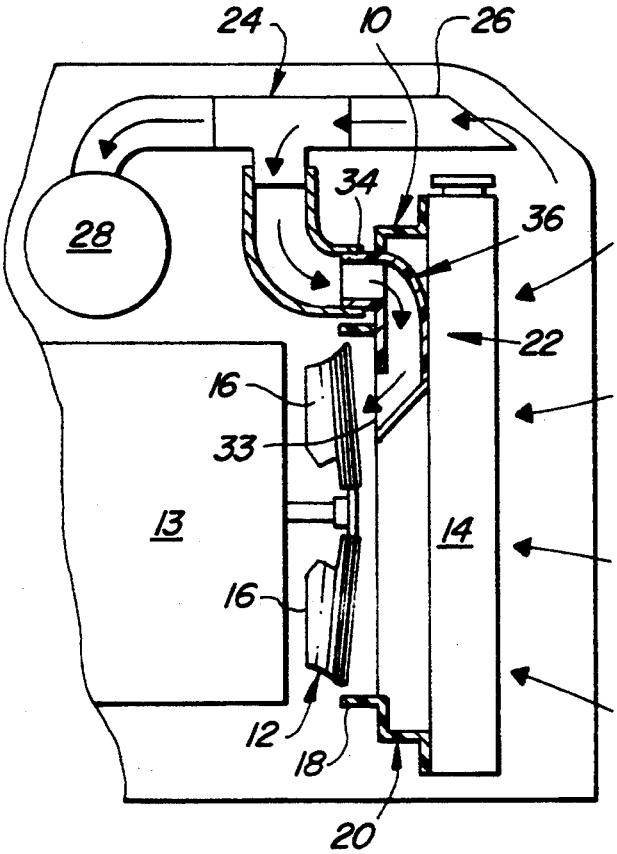
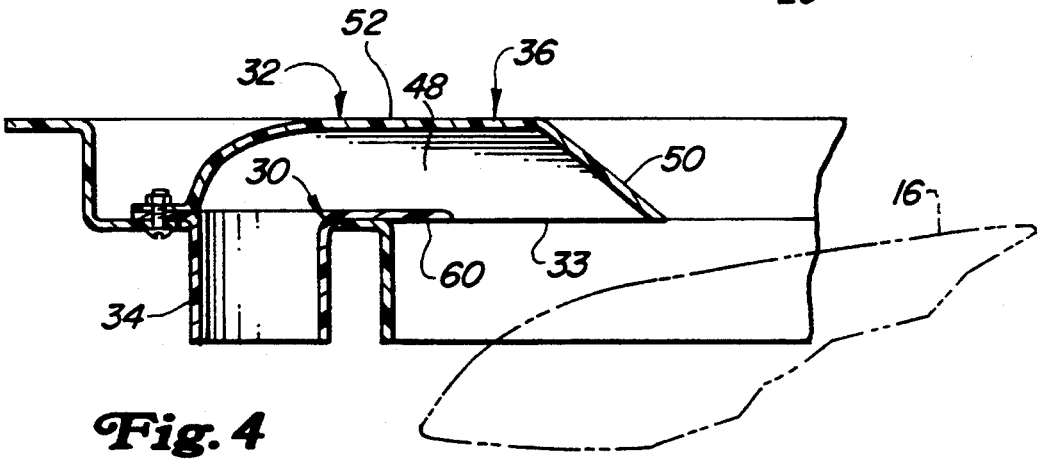
Fig. 4

FAN SHROUD ASPIRATOR

BACKGROUND OF THE INVENTION

The invention relates to an aspirator for use in conjunction with an engine fan shroud to provide a vacuum.

Engine air intake systems have typically included a scoop, precleaner, ducts of varying lengths, and an air cleaner. Such a precleaner requires a vacuum to pull or "scavenge" small dirt particles out of the fresh air ingested into the air intake system inlet or scoop. Exhaust system aspirators have been used to supply the required vacuum. But an exhaust system aspirator will create a restriction in the engine exhaust, raise noise levels and raise the cost of the muffler and/or the exhaust pipe. Also, a check valve is needed to prevent backflow of high temperature gasses into the precleaner and high temperature hoses must be used.

Some production vehicles have used a fan shroud aspirator as a source of vacuum to a precleaner which scavenges dirt from their cab air intake system. This aspirator is merely an opening in the shroud enabling a hose to link with the precleaner. With this type of fan shroud aspirator certain conditions also create back flow into the precleaner, therefore dirt particles are not removed from the air. Accordingly, it would be desirable to have a precleaner aspirator which avoids the disadvantages associated with the aforementioned aspirators.

SUMMARY OF THE INVENTION

Accordingly, an object of this invention is to provide a precleaner aspirator which does not require a restriction in the engine exhaust, raise noise levels or raise the cost of the muffler and/or the exhaust pipe.

A further object of the invention is to provide such a precleaner aspirator which does not require a check valve.

Another object of the invention is to provide such a precleaner aspirator which does not create back flow into the precleaner.

These and other objects are achieved by the present invention, wherein an aspirator is mounted on a fan shroud surrounding a vehicle cooling fan. The aspirator has a housing which forms a duct which connects an opening to a port for connecting to a vehicle function. The aspirator is spaced apart from the fan and upstream from the fan and extends at an acute angle with respect to a tangent to a cylindrical wall of the shroud. The aspirator has a near edge which faces generally opposite to a direction of rotation of the fan blades and which is parallel to a leading edge of a fan blade when the leading edge is spaced apart from the near edge by a distance which is slightly larger than the width of the fan blade. The aspirator has a flange which projects parallel to a plane of rotation of the fan and generally in the rotation direction of the fan. The duct has a triangular cross sectional shape with an apex which projects in a direction which is upstream with respect flow of air moved by the fan.

BRIEF DESCRIPTION OF THE DRAWINGS

FIG. 1 is a simplified schematic view of an assembly of vehicle engine components with a precleaner aspirator according to the present invention;

FIG. 3 is a view taken along lines 3—3 of FIG. 2;

FIG. 4 is a sectional view taken along line 4—4 of FIG. 2; and

DETAILED DESCRIPTION OF THE PREFERRED EMBODIMENT

Figure 2:
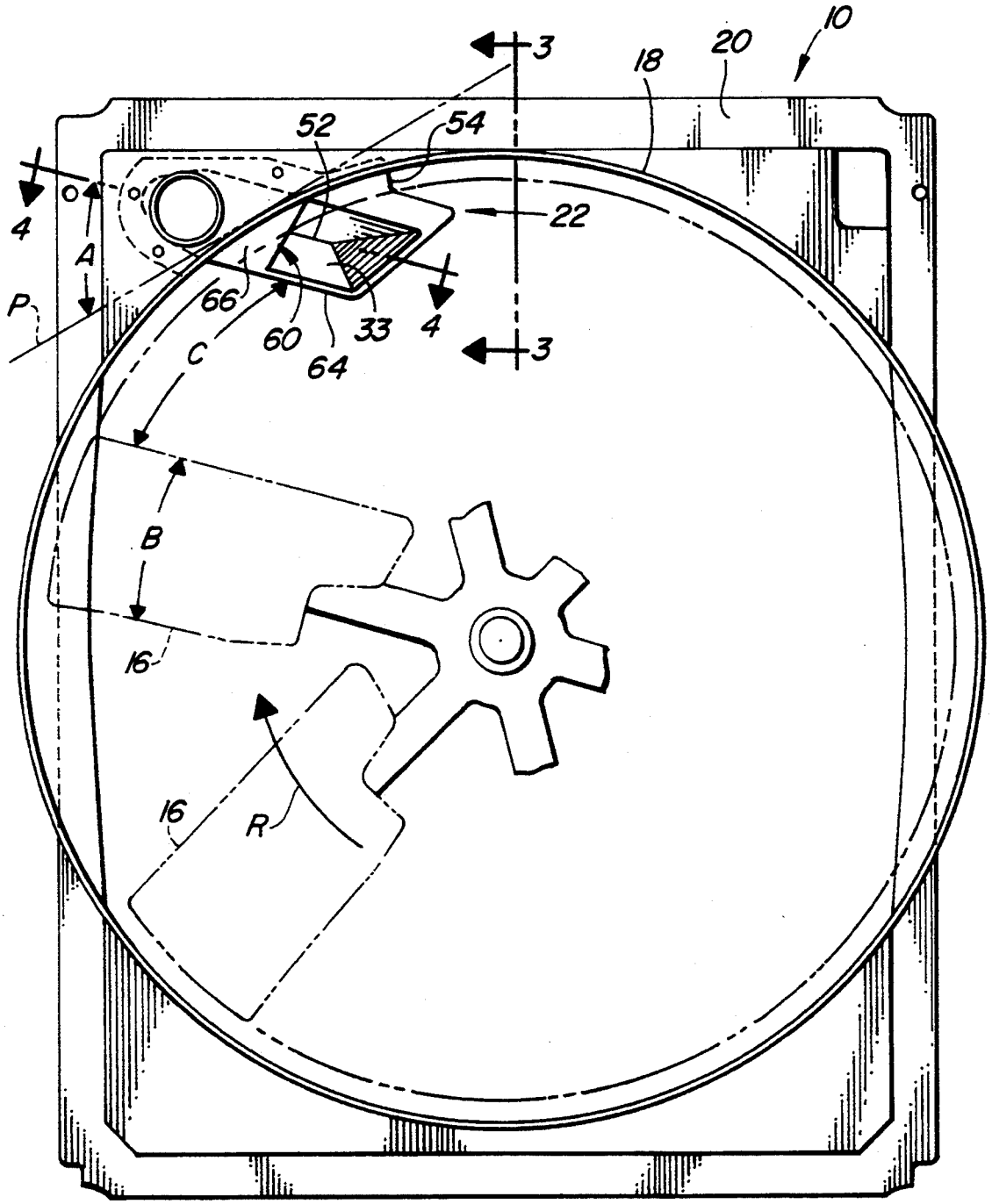
FIG. 2 is an end view of the aspirator of the present invention mounted on a fan shroud.

Referring to FIGS. 1 and 2, a fan shroud 10 generally surrounds a vehicle cooling fan 12 and the region between the fan 12 and the radiator 14. The fan 12 is driven by engine 13 and includes a plurality of blades 16 which rotate (in a clockwise direction viewing FIG. 2) about an axis to cause air to move through the radiator 14. The blades 16 have outer ends which define a cylindrical envelope. The shroud 10 includes a generally cylindrical wall 18 supported by a rectangular base 20. The wall 18 concentrically surrounds the fan 12 and is positioned radially outwardly with respect to the cylindrical envelope. As best seen in FIG. 1, the aspirator 22 is spaced apart from the fan blades 16 and is upstream from the fan 12 with respect to air flow direction.

Figure 5:
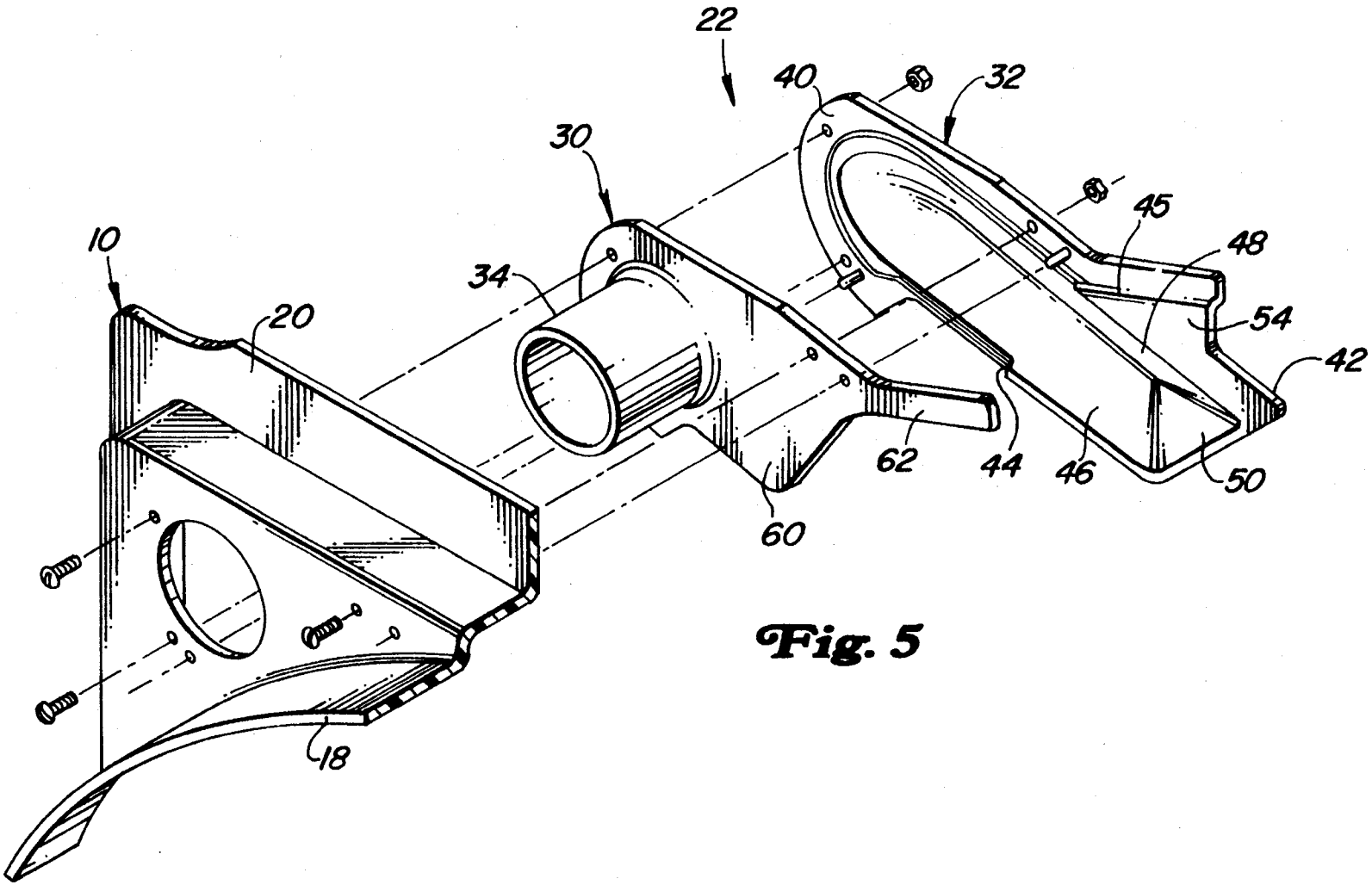
FIG. 5 is an exploded view of the aspirator of the present invention and a portion of the fan shroud to which it is mounted.

An aspirator 22 provides a source of vacuum to a precleaner 24 which scavenges dirt from the cab air intake 26 before it reaches an engine air cleaner 28. As best seen in FIG. 5, the aspirator 22 includes a base housing part 30 and a cover housing part 32 which are joined together and to a corner of the fan shroud 10. The housing parts 30 and 32 together form an opening 33 which is exposed to air moved by the fan 12. Housing base part 30 forms a port 34 which extends through an opening in the fan shroud and is connected to the precleaner 24. The housing parts 30 and 32 together form a duct 36 which extends from the opening 33 to the port 34. The duct 36 therefore has a triangular cross sectional shape with an apex which projects in a direction which is upstream with respect flow of air moved by the fan 12.

The cover housing 32 includes an inner rim 40 joined to an outer rim 42 by shoulders 44 and 45. Projecting from the rims 40 and 42 are a first side wall 46, a second side wall 48 and a triangular end piece 50. The side walls 46 and 48 are joined together to form ridge 52 which projects away from the fan and in a direction opposite to the direction of air flow. A portion of the cover housing 32 forms a generally triangular flange 54 which projects generally in the direction of rotation of the fan blades 16 and substantially parallel to a plane of rotation of the fan 12. The radially outer ends of the side walls 46 and 48 are smoothly contoured and curved and joined together and joined to the inner rim 40 so that the side walls 46, 48 and the inner rim 40 form a smooth, aerodynamic and continuous surface which is closed in a direction facing upstream with respect to flow of air moved by the fan 12.

The base housing part 30 includes a flat plate 60 from which an arm 62 projects. The base housing part 30 is attached to the cover housing 32 so that an edge of the plate 60 engages the shoulder 44 and arm 62 engages shoulder 45. The outer rim 42 and the edge of plate 60 define the opening 33. Plate 60 and the cover housing part 30 together form the duct 36 which extends from the opening 33 to the port 34.

As best seen in FIG. 2, the aspirator 22 has a leading edge 64 which is located on a side of the aspirator 22 which is oriented generally towards the fan blades 16 as the fan blades rotate towards the aspirator in the direction of arrow R. The aspirator 22 extends from a generally outer end which is spaced radially outwardly with respect to the cylindrical wall 18 of the shroud 10 to a radially inner end which is spaced radially inwardly with respect to the cylindrical envelope defined by the fan blades 16. The aspirator 22 has a longitudinal axis parallel to ridge 52 which forms an acute angle A with respect to a plane P which is tangent to the cylindrical wall 18 of the shroud at the point where the aspirator crosses the wall 18.

Each fan blade 16 has a leading edge facing generally in a direction opposite to the direction of fan rotation, and a trailing edge facing generally in the direction of fan rotation. These edges are substantially parallel to each other. These edges have projections on a plane perpendicular to an axis of rotation of the blades which are separated by a distance B. Preferably, the aspirator 22 is oriented so that its leading edge has a projection on this plane which is parallel to a projection of the near edge of the fan blade 16 when the projection of the near edge is spaced apart from the aspirator leading edge by a distance C which is slightly larger than the distance B. Also, a generally triangular portion 66 of the plate 60 is exposed or located radially inwardly with respect to the shroud wall 18.

It has been found that distance C should vary as a function of fan blade diameter. Assuming that the fan blade projected width B and the other shapes and relationships remain the same, the "parallel spacing" distance C should be decreased if the fan diameter and the shroud wall diameter is decreased. For example, with a 711 milimeter diameter fan with twisted blades having a width B of 133 mm, a straight shroud, it was found that performance was optimized when distance C is about 154 mm or about 1.15 times fan blade width B. With 582 milimeter diameter fan with flare tip untwisted blades having a width B of 129 mm, a flared tip shroud, it was found that performance was optimized when distance C is about 87 mm or about 0.67 times fan blade width B. In other words, the ratio of C to B is preferably between 1.15 and 0.67. It has also been found that the closest axial distance between the fan 12 and the aspirator 22 should be substantially the same as the radial spacing between the shroud wall 18 and the outer ends of the fan blades 16.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. An aspirator for a fan shroud surrounding a vehicle cooling fan having a plurality of blades which rotate about an axis to cause air to move through a radiator, the blades having outer ends which define a cylindrical envelope, the fan shroud having a generally cylindrical wall which surrounds the fan and which is positioned radially outwardly with respect to the cylindrical envelope, the aspirator having a housing defining an opening exposed to air moved by the fan and a port for connecting to a vehicle function, characterized by:

the aspirator housing has a longitudinal axis which lies in a plane which is perpendicular to the rotation axis of the blades and which forms an acute angle with respect to a plane which is tangent to the cylindrical wall of the shroud, and the opening is positioned radially inwardly with respect to the cylindrical envelope and faces in a direction which is parallel to the rotation axis of the blades.

2. An aspirator for a fan shroud surrounding a vehicle cooling fan having a plurality of blades which rotate in a rotation direction about an axis to cause air to move through a radiator, the aspirator having a housing defining an opening exposed to air moved by the fan, a port for connecting to a vehicle function and a duct for extending from the opening to the port, characterized by:

the aspirator housing having a flange which projects from one side of the duct, the flange projecting from the duct generally in said rotation direction and the flange comprising a flat member which is substantially parallel to a plane of rotation of the fan.

3. An aspirator for a fan shroud surrounding a vehicle cooling fan having a plurality of blades which rotate in a rotation direction about an axis to cause air to move through a radiator, the aspirator having a housing defining an opening exposed to air moved by the fan, a port for connecting to a vehicle function and a duct for extending from the opening to the port, characterized by:

the duct having a triangular cross sectional shape with an apex which projects in a direction which is upstream with respect to flow of air moved by the fan.

4. An aspirator for a fan shroud surrounding a vehicle cooling fan having a plurality of blades which rotate in a rotation direction about an axis to cause air to move through a radiator, the aspirator having a housing defining an opening exposed to air moved by the fan, a port for connecting to a vehicle function and a duct for extending from the opening to the port, the improvement wherein the duct comprises:

first and second side walls which are joined together to form a ridge which projects in a direction which is upstream with respect to flow of air moved by the fan;

a triangular end wall which extends between the side walls, the side walls and the end wall forming a continuous surface which is closed in a direction facing upstream with respect to the flow of air moved by the fan; and a plate coupled to the first and second side walls, the plate, the side walls and the end wall forming the opening therebetween.

5. The aspirator of claim 4, wherein:

the fan shroud has a generally cylindrical wall which surrounds the fan; and a generally triangular portion of the plate is located radially inwardly with respect to the generally cylindrical wall.

6. The aspirator of claim 4, wherein:

the port is formed by an outer end of the plate.

7. The aspirator of claim 4, wherein:

a flange projects from one side of the duct, the flange projecting from the duct generally in a direction of rotation of the fan, and the flange comprising a flat member which is substantially parallel to a plane of rotation of the fan.

8. The aspirator of claim 4, wherein:

the duct has a triangular cross sectional shape with an apex which projects in a direction which is upstream with respect to the flow of air moved by the fan.

9. An aspirator for a fan shroud surrounding a vehicle cooling fan having a plurality of blades which rotate about an axis to cause air to move through a radiator, the blades having outer ends which define a cylindrical envelope, each blade having a leading edge and a trailing edge, these edges being substantially parallel to each other and having projections on a plane perpendicular to the axis of rotation of the blades which are separated by a distance B, the fan shroud having a generally cylindrical wall which surrounds the fan and which is positioned radially outwardly with respect to the cylindrical envelope, the aspirator having a housing defining an opening exposed to air moved by the fan and a port for connecting to a vehicle function, the aspirator housing has a longitudinal axis which forms an acute angle with respect to a plane which is tangent to the cylindrical wall of the shroud, characterized by:

the aspirator housing having an edge facing generally opposite to a direction of rotation of the fan blade, said housing edge having a projection on said plane which is parallel to the projection of the leading edge of the fan blade when the projection of the leading edge is spaced apart from the housing edge by a distance C, a ratio of C to B being between 1.15 and 0.67.

10. An aspirator for a fan shroud surrounding a vehicle cooling fan having a plurality of blades which rotate about an axis to cause air to move through a radiator, the blades having outer ends which define a cylindrical envelope, the fan shroud having a generally cylindrical wall which surrounds the fan and which is positioned radially outwardly with respect to the cylindrical envelope, the aspirator having a housing defining an opening exposed to air moved by the fan and a port for connecting to a vehicle function, the aspirator housing forming a duct which extends from the opening to the port, the aspirator housing having a longitudinal axis which forms an acute angle with respect to a plane which is tangent to the cylindrical wall of the shroud, characterized by:

the aspirator housing having a flange which projects from one side of the duct, the flange projecting from the duct generally in a direction parallel to a rotation direction of the fan and substantially parallel to a plane of rotation of the fan.

11. An aspirator for a fan shroud surrounding a vehicle cooling fan having a plurality of blades which rotate about an axis to cause air to move through a radiator, the blades having outer ends which define a cylindrical envelope, the fan shroud having a generally cylindrical wall which surrounds the fan and which is positioned radially outwardly with respect to the cylindrical envelope, the aspirator having a housing defining an opening exposed to air moved by the fan and a port for connecting to a vehicle function, the aspirator housing having a longitudinal axis which forms an acute angle with respect to a plane which is tangent to the cylindrical wall of the shroud, characterized by:

the aspirator housing forming a duct which extends from the opening to the port, the duct having a triangular cross sectional shape with an apex which projects in a direction which is upstream with respect to flow of air moved by the fan.

* * * * *